United States Patent [19]

Rendell

[11] 4,365,534

[45] Dec. 28, 1982

[54] MODIFIED MUSICAL INSTRUMENT STRING

[75] Inventor: Stanley E. Rendell, Kalamazoo, Mich.

[73] Assignee: Sterlingworth Music, Inc., Kalamazoo, Mich.

[21] Appl. No.: 129,481

[22] Filed: Mar. 11, 1980

[51] Int. Cl.[3] ..... G10D 3/10

[52] U.S. Cl. ..... 84/297 S

[58] Field of Search ..... 84/199, 297 S; 29/505

[56] References Cited

U.S. PATENT DOCUMENTS

| | | | |
|---|---|---|---|
| 2,049,769 | 8/1936 | Gray | 84/199 |
| 2,205,144 | 6/1940 | Kaplan | 84/297 S |
| 2,241,282 | 5/1941 | Wackerle | 84/297 S |
| 2,641,949 | 6/1953 | Jensen | 84/297 S |
| 2,762,251 | 9/1956 | Infeld | 84/199 |

FOREIGN PATENT DOCUMENTS

| | | | |
|---|---|---|---|
| 1264160 | 5/1961 | France | 84/297 S |
| 1566607 | 9/1978 | United Kingdom | 84/297 S |

OTHER PUBLICATIONS

*The Music Trades,* "Introducing D'Addario Half Round", Jun. 1976, p. 70.

*Primary Examiner*—L. T. Hix
*Assistant Examiner*—Alan Mathews
*Attorney, Agent, or Firm*—Gordon W. Hueschen

[57] ABSTRACT

A modified musical instrument string comprising a core having a fine cover wire helically wound thereon, said cover wire having a substantially round cross-section over the major proportion of its surface, but having compressed flats at the crown of said wire at the outer surface of said string but not at the inner surface of said cover wire. Said modification is effected by apparatus comprising a first roller having a fixed axis and a second roller mounted on a moveable arm for moving the second roller toward and away from the first roller, and a controllable air cylinder apparatus connected to said moveable arm for moving the second roller toward the first roller. As the string being wound and rotating passes between the two rollers between guides, the crown or outer arcuate surface of the helical winding at the outer surface of the string is flattened by passing the string while it is rotating between rollers biased toward each other, resulting in a string which produces less noise when the player slides his fingers along the string to change positions, and which still provides perfect intonation and frequency response. The method for modifying such a wound musical instrument string is also disclosed.

3 Claims, 3 Drawing Figures

MODIFIED MUSICAL INSTRUMENT STRING

BACKGROUND OF THE INVENTION (1) Field of the Invention

The present invention relates to musical instrument strings, and more particularly refers to strings which have been modified to reduce the generation of noise when the player slides his fingers along the strings.

(2) Description of the Prior Art

Musical instrument strings are manufactured by winding a fine metal wire around a core. The wire may be formed of silver, copper, alloys of either or both, or aluminum. The cores are formed of gut, nylon, or metal wire such as steel. Since the fine wire wound around the core has a substantially circular cross-section in order to provide good intonation, when the player slides his fingers along the strings, since the peaks of the wire are spaced apart, a considerable amount of noise results. Various means have been utilized to modify the string to avoid or reduce the degree of noise. In one method, the string is ground with a centerless grinder after the string has been wound to produce a flat surface. This method has a disadvantage in that the mass of the wire winding is reduced. To compensate for this, it has been found necessary to use both a larger diameter core and a larger diameter covering wire. To utilize a string manufactured by this method, it is necessary to increase the amount of tension to bring the string to pitch. This adversely affects the intonation of the string. Another method which has been used in the prior art is called Roller Wound. Here the round cover wire is pulled through a pair of rollers and a flat is put on both the top and bottom side of the cover wire prior to winding the wire about the core. The disadvantage of this method is that a larger portion of the covering wire is in contact with the core at one of the flat surfaces. This adds considerable stiffness to the string. Another disadvantage is that it is not always possible to ensure that the flat portion lies parallel to the core wire. When mis-positioning of this type occurs, a sawtooth effect results and the string feels rough to the player. Additionally, this adversely affects the intonation of the string.

It has been found that the ideal string is one where the cover wire is round and the only contact made with the core is at the point of tangency with the cover wire. When the right combination of core and cover wire size is used, the intonation of the string is perfect and the harmonics are readily discernible to the trained ear. The only objection found in this ideal string is the resulting finger noise which is heard as the player slides his fingers up and down the string. In addition to the objectionable noise, the wire structure can result in excessive fret wear.

SUMMARY OF THE INVENTION

It is an object of the present invention to provide a musical instrument string which produces less noise when the player slides his fingers up and down the string.

It is an additional object to provide a musical instrument string of the type described which retains excellent physical properties.

It is still another object to provide such a musical instrument string wherein the intonation and harmonic properties of the string are not already affected.

It is still an additional object to provide a modified musical instrument string which is relatively inexpensive to produce.

It is an additional object to provide a method for modifying a musical instrument string which results in a string which is quiet in use when the player slides his fingers along the string, and which still has excellent musical properties.

It is a principal object of the invention to provide a musical instrument string comprising a core having a fine cover wire helically wound thereon, said cover wire having a substantially round cross-section over the major proportion of its surface, but having compressed flats at the crown of said wire at the outer surface of said string but not at the inner surface of said cover wire.

Other objects and advantages of the invention will become apparent upon reference to the drawings and detailed description.

According to the invention, a musical instrument string is provided which is first fabricated by winding a cover wire helically about a core. The string is then further processed by rotating the string and passing it between spring-loaded rollers. As a result, the peaks of the fine helically wound wire are compressed and flattened. A string results which is very quiet when the player slides his fingers along the string, and yet which is very true in pitch and harmonics.

DESCRIPTION OF THE PREFERRED EMBODIMENT

Figure 1:
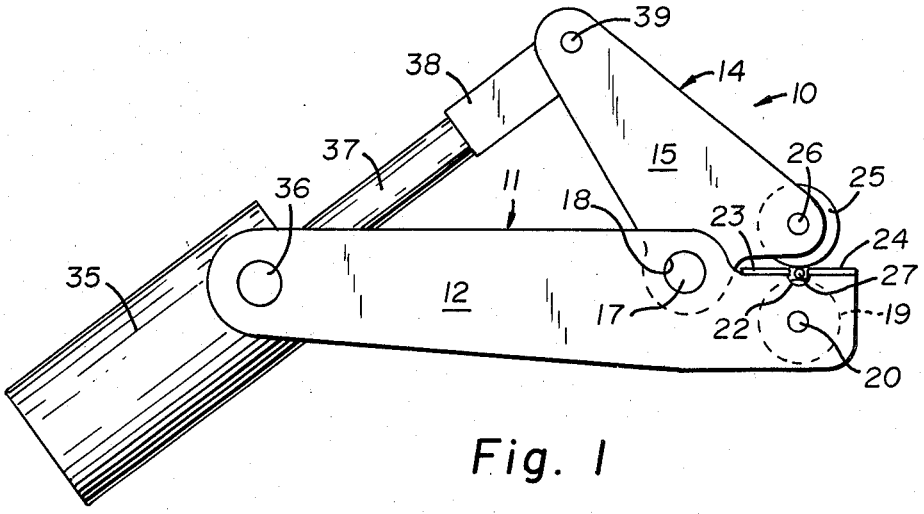
FIG. 1 is a side view of the apparatus used in producing a string according to the invention.
Figure 2:
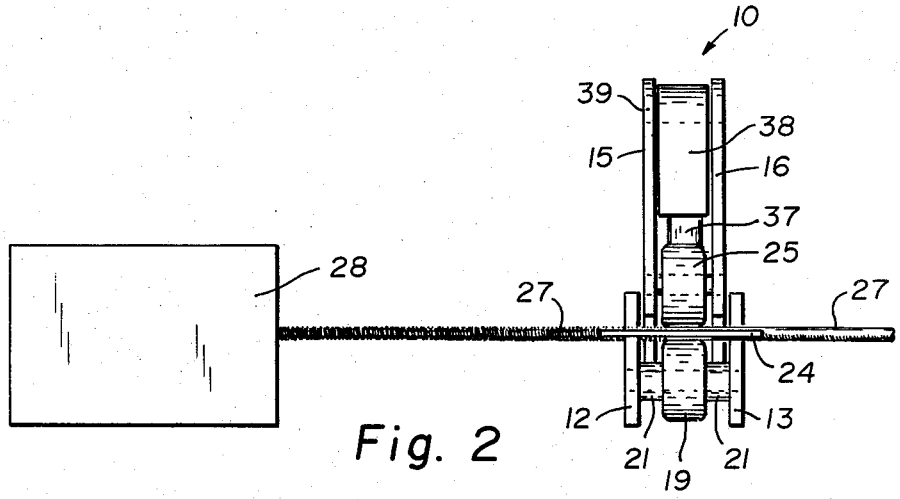
FIG. 2 is an end view of the apparatus shown in FIG. 1.

Referring to FIGS. 1 and 2, a string modifying device 10 according to the invention is shown comprising a frame 11 formed of frame members 12 and 13. A bell crank lever arm 14 comprising lever arm members 15 and 16 is pivotally connected to the frame 11 by a pivot pin 17 riding in apertures 18 provided in the frame members. A roller 19 is rotatably mounted on a pin 20 which provides a fixed axis. Spacers or hubs 21 maintain the roller 19 in centered position. A recess 22 is provided in the frame members 12 and 13 for permitting a string 27 to pass therethrough. Centering guides 23 and 24 in the form of flat plates are affixed to the frame members 12 and 13 to keep a string 27 which is being processed in centered position. A moveable roller 25 is rotatably mounted by means of a pin 26 on the bell crank lever arm 14. As shown in FIG. 2, a conventional string fabricating apparatus 28 shown in box diagram is mounted adjacent to the string modifying device 10.

An air cylinder 35 is provided for applying force to the moveable roller 25 in the direction of the fixed roller for compressing a string being processed. The air cylinder 35 is mounted by means of a pin 36 to one end of the frame 11. A piston rod 37 extends from the air cylinder 35 and has an enlarged portion 38 which is pivotally affixed to one end of the bell crank lever arm 14 by means of a pin 39.

Figure 3:
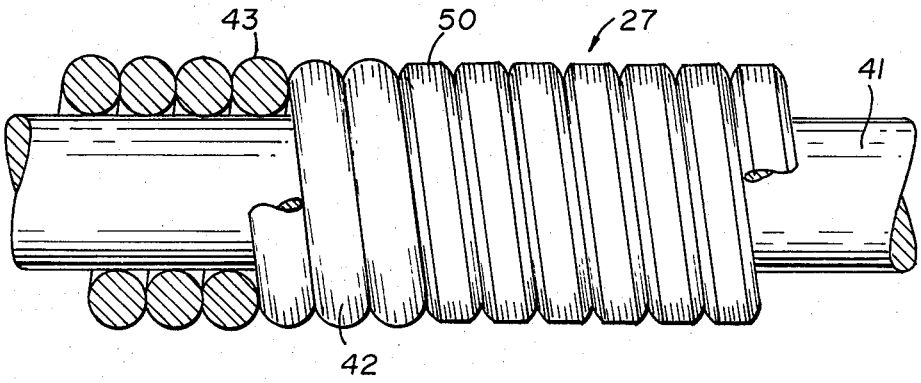
FIG. 3 is an enlarged side elevational view of a string according to the invention showing a portion after it has been processed and a portion before it has been processed.

Referring to FIG. 3, musical instrument string 27 is shown in enlarged view and comprises a core 41 formed of gut, nylon, or a metal such as steel. A fine wire 42 is wound about the core in a helical arrangement. As the string is originally formed, the wire is circular in cross-section and has arcuate upper surface or crown 43. After processing according to the process of the invention and in the apparatus of the invention, the outer surface of the string windings is compressed to form flat surfaces 50.

In operating the string modifying device 10 according to the invention, the string is first formed in a conventional string fabricating apparatus 28, shown in FIG. 2, which is placed adjacent to the string modifying device 10. The apparatus 28 forms a string by rotating the core and winding the fine wire 42 around the core in a helical arrangement with the sides of each winding in contact engagement with adjacent windings. As the finished string continues to rotate and to be pushed out of the apparatus 28, the finished portion of the string passes between the rollers 19 and 25. The air cylinder, or hydraulic cylinder if desired, forces the piston rod 37 and 38 to apply force outwardly to the end of the bell crank lever arm 14. This causes the moveable roller 25 to press against the string 27 which in turn is supported by the roller 19 having a stationary axis, and the string is maintained in position by the guides 23 and 24. The desired roller force may be applied by properly adjusting controls to the air cylinder 35. As the string continues to roll and pass axially between the rollers 19 and 25, the crown 43 of the covering wire is compressed to form a flat 50. The degree of compression is carefully controlled by controlling the pressure applied to the air cylinder. This results in a string which does not generate noise when the fingers of the player slide longitudinally with the string. Moreover, the string remains true in pitch and overtones. It has been found that a very highly satisfactory guitar string can be fabricated using a core wire having a diameter of 0.014 inch, and cover wire having a diameter of 0.05 inch, to form a string with an initial untreated diameter of 0.024 inch. After processing by flattening the crowns of the cover wire, the resulting diameter of the string is 0.023 inch.

The apparatus of the present invention has a number of advantages over apparatus and methods which have been utilized in the past to accomplish the same purposes. First, it permits a string to be fabricated by winding with a cover wire having a circular cross-section. It has been found from experience that this provides a string with the best intonation and frequency response. As the string is being formed and rotated it is passed between the compressive rolls of the present invention, which compresses the outer crown of the wire which has been wound on the core and causes the crown to be flattened. However, the crown of the cover wire adjacent to the core remains substantially uncompressed. Consequently a string results which does not generate noise when the player rubs his fingers along the string, but which still has perfect intonation and frequency response. Further, the apparatus of the present invention is relatively simple and inexpensive to produce and operate so that a string may be inexpensively processed while it is being rotated by the apparatus which forms the string. The guide means of the present invention surely keep the wire centered and positioned between the rollers so that a uniform, smooth, flat surface is produced. Further, although the crown of the cover wire is flat as a result of the processing, no metal has been removed from the string and consequently the intonation and harmonic response has not been impaired.

The musical instrument string of the invention, then, comprises a core having a fine cover wire helically wound thereon, said cover wire having a substantially round cross-section over the major proportion of its surface, but having compressed flats at the crown of said wire at the outer surface of said string but not at the inner surface of said cover wire, having the aforementioned advantageous properties and characteristics.

It is to be understood that the invention is not to be limited to the exact details of operation or structure shown and described in the specification and drawings, since obvious modifications and equivalents will be readily apparent to one skilled in the art.

Invention is claimed as follows:

1. A musical instrument string comprising a core having a fine cover wire helically wound thereon, said cover wire having a substantially round cross-section over the major proportion of its surface, but having compressed flats at the crown of said wire at the outer surface of said string but not at the inner surface of said cover wire.

2. A musical instrument string comprising a core having a fine cover wire helically wound thereon, said cover wire having a substantially round cross-section over the major proportion of its surface, but having flats at the crown of said wire at the outer surface of said string formed by compressing said string between rollers as said string rotates.

3. A musical instrument string according to claim 2, wherein said core is formed of metal and said cover wire is formed of metal.

* * * * *